US007083126B2

(12) United States Patent
Lehtonen et al.

(10) Patent No.: US 7,083,126 B2
(45) Date of Patent: Aug. 1, 2006

(54) FUEL INJECTION ARRANGEMENT

(75) Inventors: Kai Lehtonen, Vaasa (FI); David C. Jay, Vähäkyrö (FI)

(73) Assignee: Wartsila Finland Oy, Vaasa (FI)

( * ) Notice: Subject to any disclaimer, the term of this patent is extended or adjusted under 35 U.S.C. 154(b) by 19 days.

(21) Appl. No.: 10/476,678

(22) PCT Filed: Apr. 18, 2002

(86) PCT No.: PCT/FI02/00323

§ 371 (c)(1),
(2), (4) Date: Mar. 11, 2004

(87) PCT Pub. No.: WO02/092994

PCT Pub. Date: Nov. 21, 2002

(65) Prior Publication Data

US 2004/0163625 A1 Aug. 26, 2004

(30) Foreign Application Priority Data

May 14, 2001 (FI) ..... 20011011

(51) Int. Cl.
*F02M 59/00* (2006.01)
*F02M 61/00* (2006.01)
*F02M 63/00* (2006.01)

(52) U.S. Cl. ..... 239/533.2; 239/533.7; 239/533.8; 239/533.12; 123/445

(58) Field of Classification Search ..... 239/533.2, 239/533.7, 533.8, 533.12, 533.15, 585.1, 239/91; 123/445
See application file for complete search history.

(56) References Cited

U.S. PATENT DOCUMENTS 5,109,822 A 5/1992 Martin
5,651,346 A 7/1997 Remmels et al.

(Continued)

FOREIGN PATENT DOCUMENTS

DE 196 12 738 10/1996
DE 19612738 A1 * 10/1996
EP 0 778 410 6/1997
EP 1 036 931 9/2000

(Continued)

OTHER PUBLICATIONS

European Patent Application EP 0778410 A1, Nylund, Dec. 6, 1996, all□□□□.*

(Continued)

*Primary Examiner*—David A. Scherbel
*Assistant Examiner*—James S. Hogan
(74) *Attorney, Agent, or Firm*—Smith-Hill and Bedell

(57) ABSTRACT

A fuel injection arrangement, which comprises a fuel source and a fuel nozzle connected thereto, including a fuel chamber and a needle valve arrangement in connection with the fuel chamber for controlling the fuel injection and an arrangement for bringing about a force effect on the valve of the needle valve arrangement in the closing direction thereof; a fuel control arrangement by means of the different switching positions of which, the fuel flow connection is connectable between the fuel source and the fuel chamber of the fuel nozzle as well as between the fuel source and the arrangement for bringing about a force effect, in which the fuel control arrangement comprises a mechanical force unit for changing its switching positions.

9 Claims, 3 Drawing Sheets

U.S. PATENT DOCUMENTS

Figure 1:
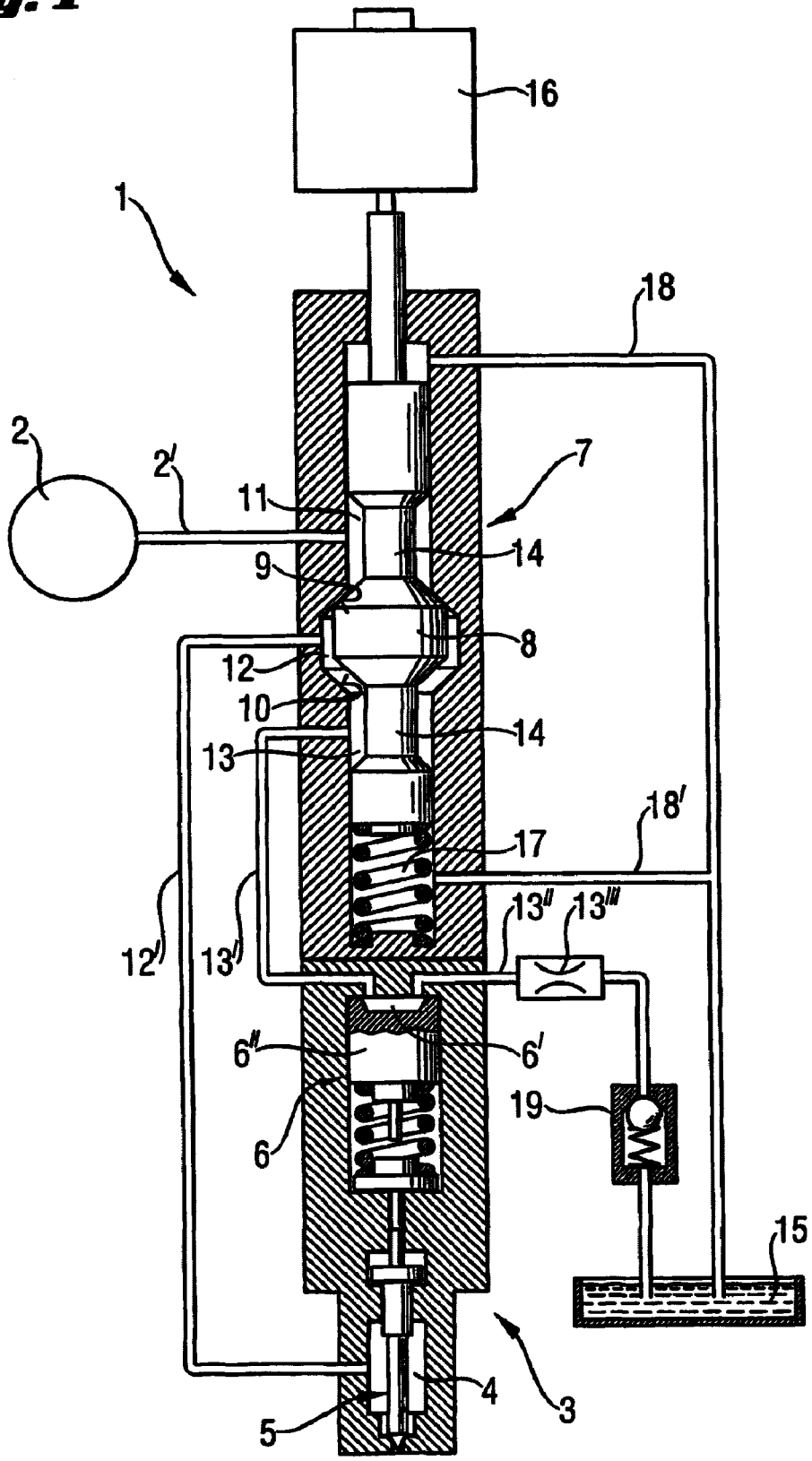

| | | | | |
|---|---|---|---|---|
| 5,941,215 | A | 8/1999 | Augustin | |
| 5,988,533 | A | 11/1999 | Augustin | |
| 6,029,632 | A | 2/2000 | Augustin | |
| 6,360,721 | B1 * | 3/2002 | Schuricht et al. | 123/446 |
| 6,532,943 | B1 * | 3/2003 | Yudanov | 123/502 |

FOREIGN PATENT DOCUMENTS

| | | |
|---|---|---|
| EP | 1 143 139 | 10/2001 |
| WO | 01/94774 | 12/2001 |

OTHER PUBLICATIONS

European Patent Application EP 1036931 A3, Askew, Sep. 20, 2000, all.*

Common Rail Fuel Injection for Heavy Fuel Medium-Speed Engines; *Proceedings,* vol. 1; 23rd CIMAC World Congress on Combustion Engine Technology; May 7-May 10, 2001; Hamburg, Germany, pp. 487-500.

* cited by examiner

FUEL INJECTION ARRANGEMENT

This is a national stage application filed under 35 USC 371 based on International Application No. PCT/FI2002/00032 filed Apr. 18, 2002, and claims priority under 35 USC 119 of Finnish Patent Application No. 20011011 filed May 14, 2001.

TECHNICAL FIELD

The invention relates to a fuel injection arrangement.

BACKGROUND ART

The fuel injection has a very big influence on operation and combustion of a diesel engine. The so-called common rail fuel injection has been developed in order to enhance the control of the combustion. One of the systems of this kind, applied especially to large engines, has been disclosed in EP 959245.

One of the factors having a particularly big influence on the operation of the engine is the successful operation and control of the injection nozzles.

DISCLOSURE OF THE INVENTION

An objective of the invention is to provide a fuel injection arrangement, by which the operation of the common rail injection is reliable and by which the risk of leakage of the injection nozzles to the combustion chamber can be minimized.

The fuel injection arrangement according to the invention comprises:

- a fuel source and a fuel nozzle connected thereto, which fuel nozzle includes a fuel chamber and a needle valve arrangement in connection with the fuel chamber for controlling the fuel injection and an arrangement for bringing about a force effect on the valve of the needle valve arrangement in the closing direction thereof,
- a fuel control arrangement, by means of the different switching positions of which, the fuel flow connection is connectable between the fuel source and the fuel chamber of the fuel nozzle as well as between the fuel source and the arrangement for bringing about a force effect, in which injection arrangement the fuel control arrangement comprises a mechanical force unit in order to change its switching positions.

The fuel control arrangement advantageously comprises a valve element, the position of the stem of which determines the operational state of the injection arrangement. There is a mechanical force unit connected to the stem, by which the stem is displaceable between the first position, in which the valve element closes the flow connection between the fuel source and the fuel chamber of the needle valve arrangement and connects the fuel chamber of the needle valve arrangement to a space allowing the lowering of its pressure, and the second position, in which there is a flow connection between the fuel source and the fuel chamber of the needle valve arrangement. According to the invention, between the first and second position the stem has an intermediate position, in which the fuel flow connection is connected from the fuel source to the arrangement for bringing about a force effect on the valve of the needle valve arrangement.

The mechanical force unit comprises a stem arrangement displaceable by electric power, which is connected to the stem of the valve arrangement. The mechanical force unit further comprises a spring arrangement or similar, which subjects the stem of the valve element to a force tending to move it to a direction which opens the needle valve arrangement.

DISCLOSURE OF DRAWINGS

Figure 2:
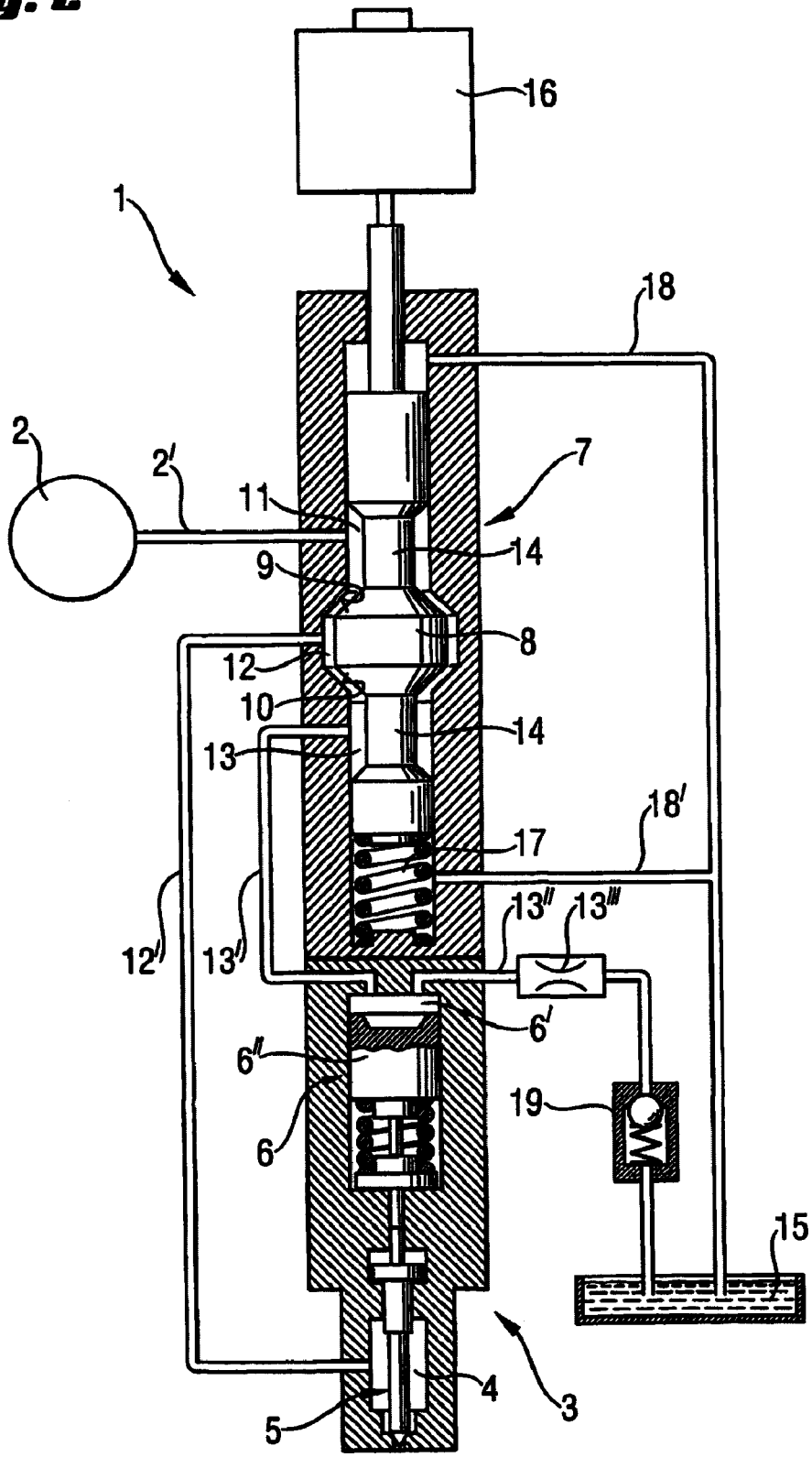
Figure 3:
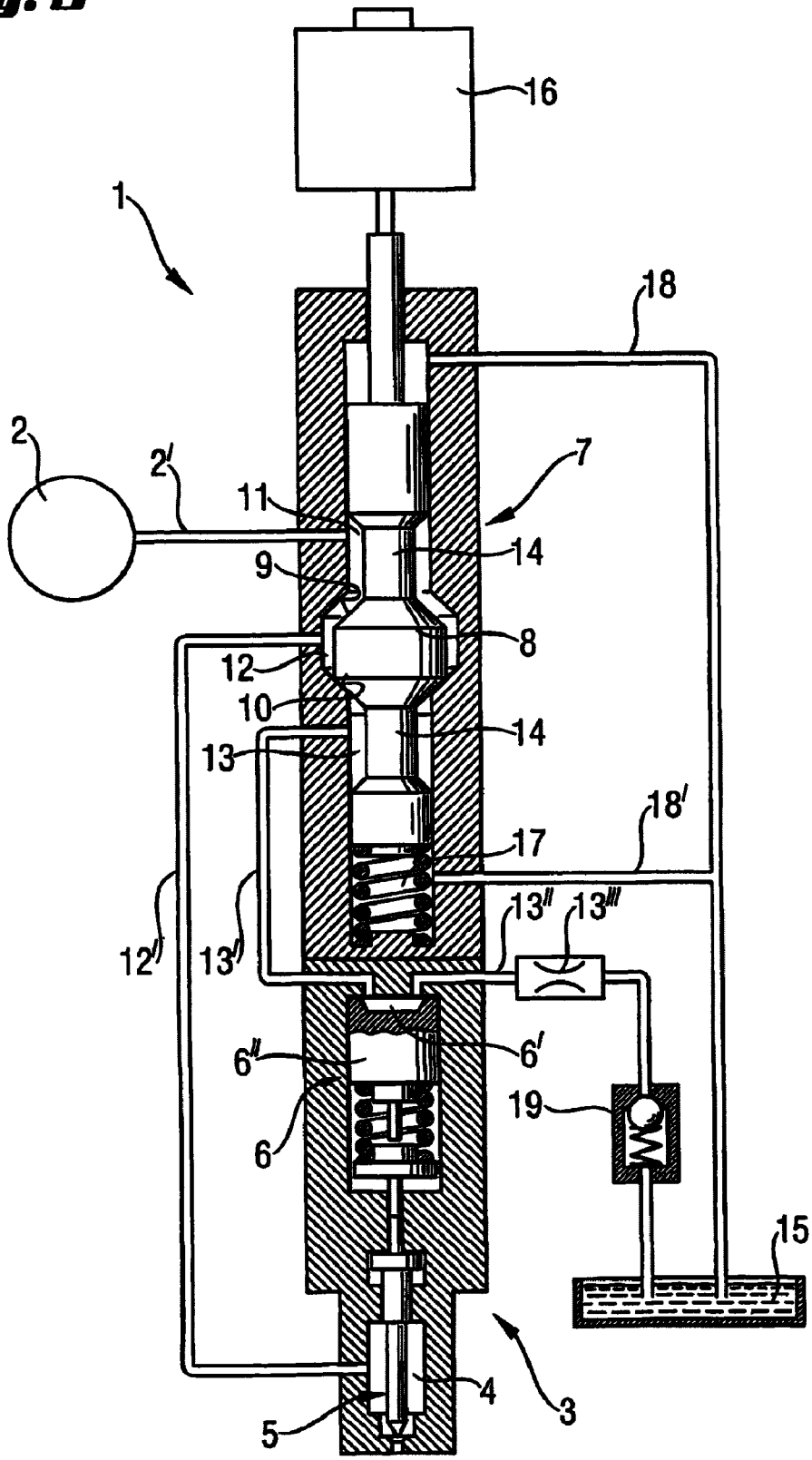

In the following, the invention will be described, by way of example, with reference to the accompanying drawings, in which FIG. 1 shows schematically the fuel injection arrangement according to the invention in the first position, FIG. 2 shows schematically the fuel injection arrangement according to the invention in the intermediate position, and FIG. 3 shows schematically the fuel injection arrangement according to the invention in the second position.

In FIG. 1, the reference numeral 1 corresponds to the fuel injection arrangement. The arrangement comprises a common rail storage 2 as the fuel source. The fuel in the common rail storage is ready in a pressurized state to be injected to the combustion chamber of the engine through a fuel nozzle 3. The fuel nozzle 3 includes a fuel chamber 4, from which fuel is injected to the engine cylinder, in connection with which the nozzle has been arranged (not shown in the Figure). The fuel nozzle also comprises a needle valve arrangement 5 for controlling the fuel injection. There is arranged, fitted with the fuel nozzle, an arrangement for bringing about a force effect 6 on the valve of the needle valve arrangement in the closing direction thereof. This arrangement 6 comprises a piston unit 6', by which the force closing the needle valve can be directed into it.

The arrangement further comprises a fuel control arrangement 7, by which the fuel flow connection is connectable between the fuel source 2 and the fuel chamber 4 of the fuel nozzle 3 as well as between the fuel source 2 and the arrangement for bringing about the force effect 6. With this arrangement, between the switching on and off of the fuel feed, a force can be directed to the needle valve arrangement in the closing direction thereof, in which case the closure of the needle is assured after the injection. The solution has also other advantages, which appear in the following description of the fuel control arrangement 7.

The control arrangement 7 comprises a valve element, the stem 8 of which has been arranged to move in the direction of its longitudinal axis in the body of the valve element 14. The stem 8 and the body 14 define together two seat surfaces 9 and 10, which separate the three fuel spaces 11, 12 and 13 of the valve element. In the first position of the stem, the stem 8 of the valve element closes the flow connection between the fuel source 2 and the needle valve arrangement 5 and connects the fuel chamber 4 of the needle valve arrangement 5 to a space allowing the lowering of its pressure 15. This situation has been represented in FIG. 1. The common rail storage 2 is connected by a duct 2' to the fuel space 11 of the control arrangement 7, which in this position of the stem is closed from the fuel space 12 by a seat surface 9. A connecting duct 12' has been arranged from the fuel space 12 into the fuel chamber 4 of the valve element. The fuel space 12 is still in this position of the stem 8, via an open seat surface 10, connected to the fuel space 13, which is connected to the piston unit space 6'. There is a further connection from the piston unit space 6' into the space 15 via duct 13". The duct 13" is advantageously equipped with a throttling element 13'" in order to restrict the flow.

For controlling the position of the stem 8 of the valve element a mechanical force unit 16, 17 is arranged, which comprises a stem arrangement 16 displaceable by electric power, fitted to the first end of the stem 8 and a spring arrangement 17, which is fitted to the second opposite end of the stem 8. With the interaction of the stem arrangement 16 displaceable by electric power and the spring arrangement 17, the stem 8 can be placed in two different positions and in the intermediate position thereof. The first position of the stem 8 has been shown in the FIG. 1. In this position, the feed from the common rail storage 2 is closed and the fuel chamber 4 is in connection with the space 15 through the fuel spaces 12 and 13, as well as via the piston unit 6', in order to lower the pressure from the fuel chamber 4. This means that the needle valve arrangement 5 is closed.

The intermediate position of the control arrangement 7, in which the fuel flow connection is connected to the arrangement for bringing about the force effect 6, has been represented in FIG. 2. By means of a mechanical force unit 16, such a force has been applied against the force of the spring 17 that the stem 8 has shifted to tile position showed in FIG. 2. Consequently, this position is the intermediate position of the stem before the third position, or before the first, depending on each moving direction of the stem. In the intermediate position illustrated in FIG. 2, the stem 8 is in such a position that both seat surfaces 9 and 10 are open, in which case the pressure of the common rail storage 2 has an effect on the valve needle and to the upper side thereof by means of the piston unit 6' as well as to the lower side thereof, in the fuel chamber 4. This guarantees that the needle remains closed before the injection. In this situation, some fuel flows out of the system through the duct 13", but the throttling 13''' has been selected to be such, that this amount is not excessive.

FIG. 3 shows a situation in which the fuel injection is in operation. Now the stem 8 is in a position, in which the seat surface 10 is closed, but the seat surface 9 is open. This means that the common rail storage 2 is in connection through the fuel space 12 with the fuel chamber 4 and when the seat surface 10 is simultaneously closed up, the pressure may fall in the piston unit 6' when it is in connection with the space 15 through the duct 13". When the injection is to be halted, the stem 8 is displaced through the position represented in FIG. 2 into the position illustrated in FIG. 1 assisted by the force unit 16. Among other things, this provides the reliable closure of the valve needle as a result of the high pressure of the common rail storage led into the piston unit 6'.

The arrangement also comprises a constant pressure valve 19, by which the pressure acting on the piston unit 6' is maintained at a certain level. By mechanically changing the position of the stem 8, the possibility of the stem 8 to get stuck is minimized, but if the stem 8 stays in an intermediate position, the needle valve arrangement 5 will close, because the pressure of the common rail storage 2 has also a valve closing influence through the piston unit 6'. This way the leaking of the fuel from the needle valve arrangement into the engine cylinder does not occur. The arrangement also comprises the ducts 18 and 18' for discharging the fuel out of the spaces remaining between the ends of the body and the stem.

The invention claimed is:

1. A fuel injection arrangement for connection to a source of fuel under pressure, the fuel injection arrangement comprising:

a fuel injection nozzle defining a fuel chamber for receiving fuel under pressure, the fuel injection nozzle comprising a needle valve element disposed in the fuel injection nozzle for controlling injection of fuel from the fuel chamber and a force mechanism for urging the needle valve element in a closing direction thereof, wherein the force mechanism comprises a piston unit provided with a flow connection through a drain duct equipped with a throttle element, and a fuel-control arrangement having an inlet for connection to the source of fuel under pressure and having a first operating state in which the fuel control arrangement isolates said inlet from both the fuel chamber and the piston unit, a second operating state in which the fuel control arrangement provides a connection between said inlet and the fuel chamber, and an intermediate state, between the first and second operating states, in which the fuel control arrangement provides a connection between said inlet and both the fuel chamber and the piston unit, and wherein the fuel control arrangement comprises a mechanical force unit for selectively transferring the fuel control arrangement between the first and second operating states by way of the intermediate state.

2. A fuel injection arrangement according to claim 1, wherein in the first operating state of the fuel control arrangement the fuel chamber is connected to the drain duct.

3. A fuel injection arrangement according to claim 1, wherein the fuel control arrangement comprises a valve member having a stem and wherein the stem is movable between a first position, in which the fuel control arrangement is in the first operating state, and a second position, in which the fuel control arrangement is in the second operating state, by way of an intermediate position, in which the fuel control arrangement is in the intermediate state.

4. A fuel injection arrangement according to claim 3, comprising a mechanical force unit coupled to the stem of the valve member for displacing the stem between the first position and the second position.

5. A fuel injection arrangement according to claim 4, wherein in the first position of the stem the fuel chamber is connected to a drain outlet.

6. A fuel injection arrangement according to claim 4, wherein in the first position of the stem the fuel chamber is connected to the drain duct.

7. A fuel injection arrangement according to claim 4, wherein in the intermediate position of the stem said inlet is connected to the piston for exerting a force on the needle valve element.

8. A fuel injection arrangement according to claim 3, wherein the mechanical force unit comprises an actuator that is connected to the stem of the valve member and is operable by electric power.

9. A fuel injection arrangement according to claim 3, wherein the mechanical force unit further comprises a spring that resists movement of the stem of the valve member in a direction from the first position towards the second position.

* * * * *